US008752662B1

(12) United States Patent
Mack

(10) Patent No.: US 8,752,662 B1
(45) Date of Patent: Jun. 17, 2014

(54) MULTIFUNCTION STORAGE BIN UTILITY APPARATUS

(76) Inventor: Jerome Mack, Leola, SD (US)

( * ) Notice: Subject to any disclaimer, the term of this patent is extended or adjusted under 35 U.S.C. 154(b) by 0 days.

(21) Appl. No.: 13/216,585

(22) Filed: Aug. 24, 2011

(51) Int. Cl.

| | |
|---|---|
| ***B62D 51/00*** | (2006.01) |
| ***B62D 51/04*** | (2006.01) |
| ***B60K 17/30*** | (2006.01) |
| ***E02F 3/60*** | (2006.01) |

(52) U.S. Cl.
USPC ..... 180/167; 180/19.1; 180/900; 180/333; 180/252; 414/486; 37/431; 172/811

(58) Field of Classification Search
USPC ..... 180/19.1, 333, 900, 252; 37/431, 443; 404/408, 546, 486, 487; 172/811
See application file for complete search history.

(56) References Cited

U.S. PATENT DOCUMENTS

| | | | | |
|---|---|---|---|---|
| 2,525,384 | A * | 10/1950 | Troutman | 414/546 |
| 4,306,329 | A | 12/1981 | Yokoi | |
| 4,776,750 | A * | 10/1988 | Griswold et al. | 414/698 |
| 4,848,010 | A * | 7/1989 | Zimmerman | 37/443 |
| 5,044,043 | A * | 9/1991 | Basham et al. | 15/319 |
| 5,940,927 | A | 8/1999 | Haegermarck | |
| 6,671,592 | B1 | 12/2003 | Bisset | |
| 6,866,465 | B2 * | 3/2005 | Jester et al. | 414/556 |
| 7,334,658 | B2 * | 2/2008 | Berg et al. | 180/333 |
| 7,430,782 | B2 | 10/2008 | Ruffo | |
| 7,448,113 | B2 | 11/2008 | Jones | |
| 7,503,134 | B2 | 3/2009 | Buckner | |
| 7,571,511 | B2 | 8/2009 | Jones | |
| 7,644,523 | B2 | 1/2010 | Buckner | |
| 2006/0032012 | A1 | 2/2006 | Buckner | |
| 2007/0168095 | A1 * | 7/2007 | Wierzba et al. | 701/41 |
| 2008/0040945 | A1 | 2/2008 | Buckner | |
| 2010/0332067 | A1 | 12/2010 | Abramson | |

* cited by examiner

*Primary Examiner* — Hau Phan
*Assistant Examiner* — Bryan Evans
(74) *Attorney, Agent, or Firm* — Jeffrey A. Proehl; Woods, Fuller, Shult & Smith, P.C.

(57) ABSTRACT

A multifunction bin utility apparatus comprises a mobile base, a plurality of wheels rotatably mounted on the mobile base with each of the wheels being rotatable independently of each other to steer movement of the mobile base, a tool mount movable with respect to the mobile base, an arm assembly mounted on the mobile base and configured to move the tool mount with respect to the mobile base, at least one tool attachment mounted on the tool mount, and a control apparatus configured to control movement of the plurality of wheels and the arm assembly with the control apparatus being remotely controllable by a remote control device.

20 Claims, 4 Drawing Sheets

MULTIFUNCTION STORAGE BIN UTILITY APPARATUS

BACKGROUND

Field

The present disclosure relates to robots and more particularly pertains to a new multifunction storage bin utility apparatus for performing functions in the interior of a storage bin without the presence of a person in the bin interior.

SUMMARY

The present disclosure describes a new multifunction storage bin utility apparatus which comprises a mobile base. A plurality of wheels may be rotatably mounted on the mobile base with each of the wheels being rotatable independently of each other to steer movement of the mobile base. A tool mount may be movable with respect to the mobile base, and an arm assembly may be mounted on the mobile base and configured to move the tool mount with respect to the mobile base. At least one tool attachment may be mounted on the tool mount. A control apparatus may be configured to control movement of the plurality of wheels and the arm assembly with the control apparatus being remotely controllable by a remote control device.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
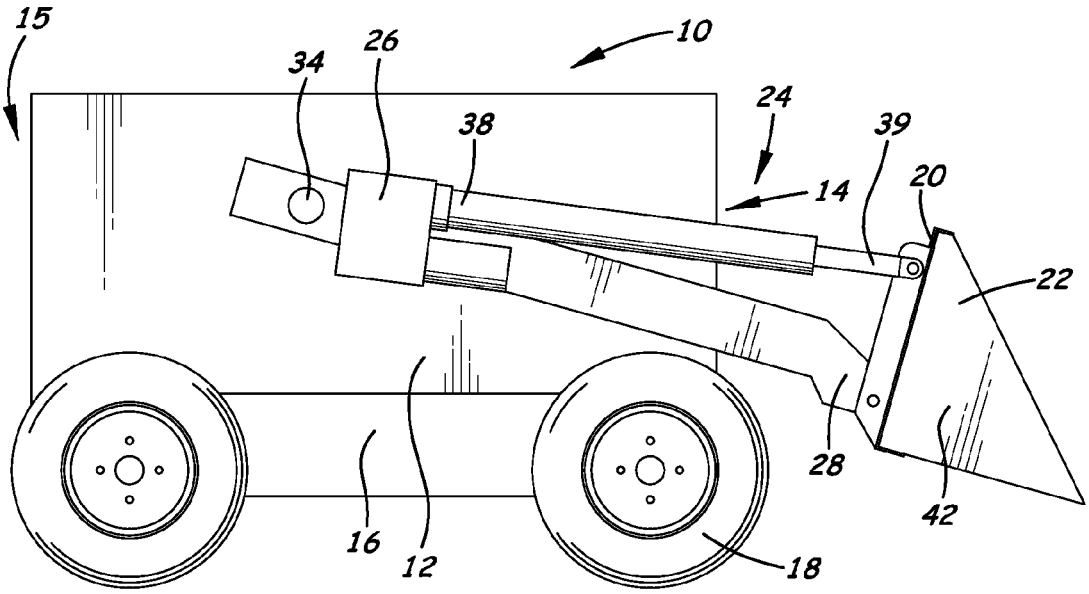
FIG. 1 is a schematic side view of a new multifunction storage bin utility apparatus according to the present disclosure, with the arm assembly and tool mount depicted in a lowered condition and a scoop bucket mounted thereon.
Figure 2:
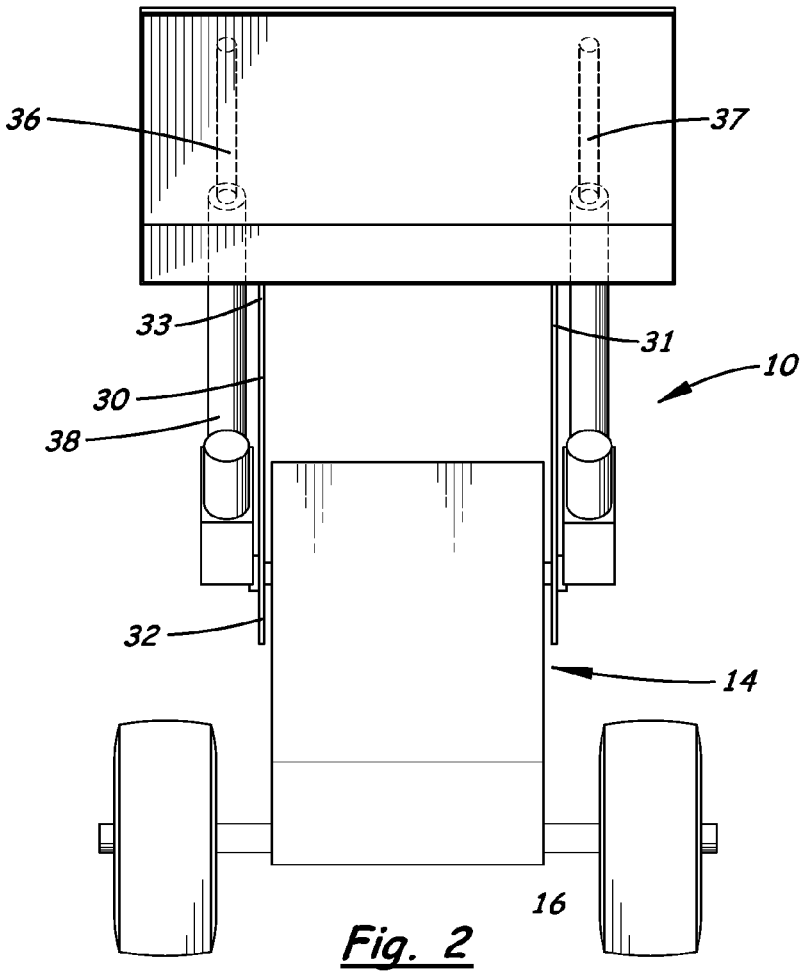
FIG. 2 is a schematic side view of the bin utility apparatus according to the present disclosure, with the arm assembly and tool mount depicted in a raised condition.
Figure 3:
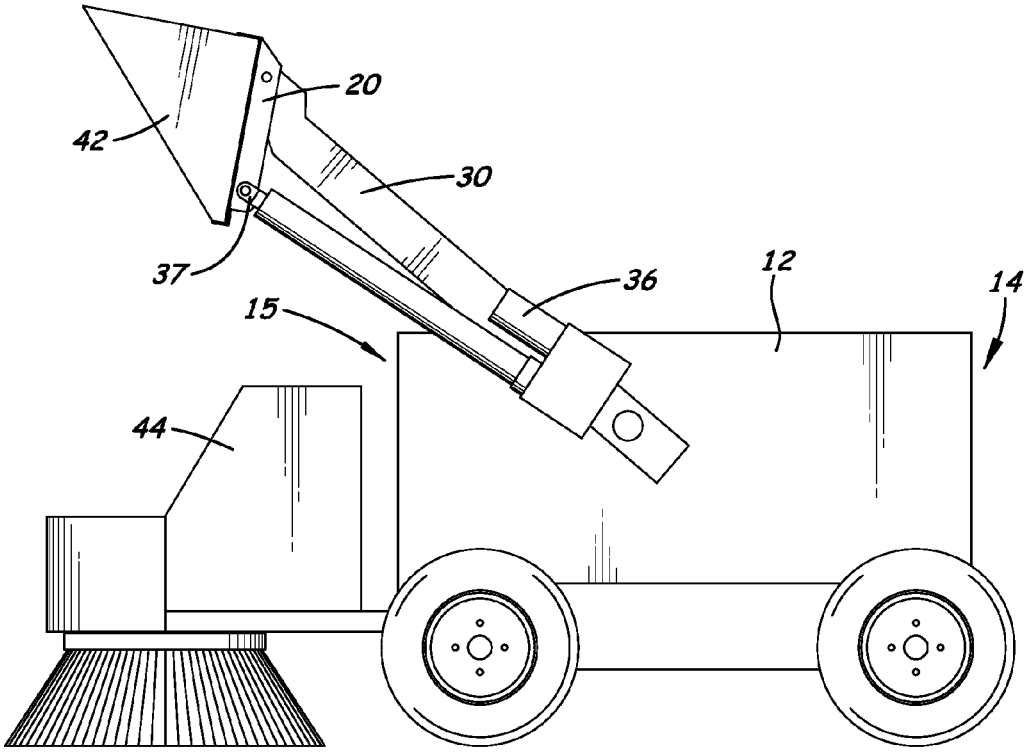
FIG. 3 is a schematic side view of the bin utility apparatus according to the present disclosure, with the arm assembly and tool mount depicted in a raised condition and positioned toward the rear of the mobile base.
Figure 4:
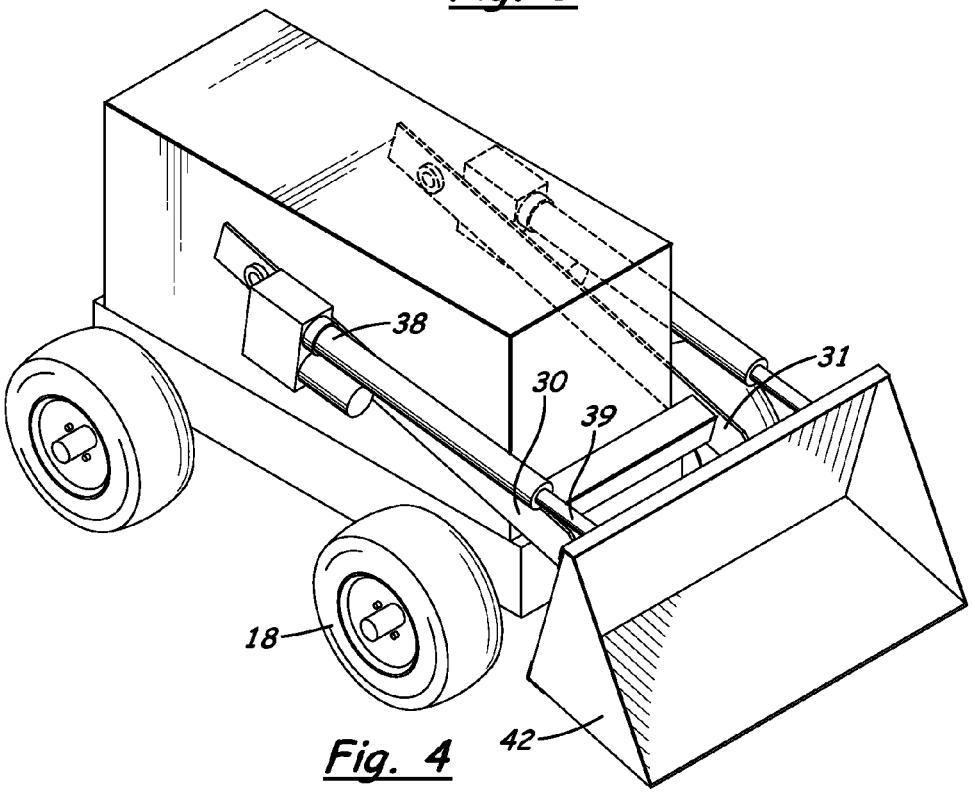
FIG. 4 is a schematic front perspective view of the bin utility apparatus according to the present disclosure, with the arm assembly and tool mount depicted in a lowered condition.
Figure 5:
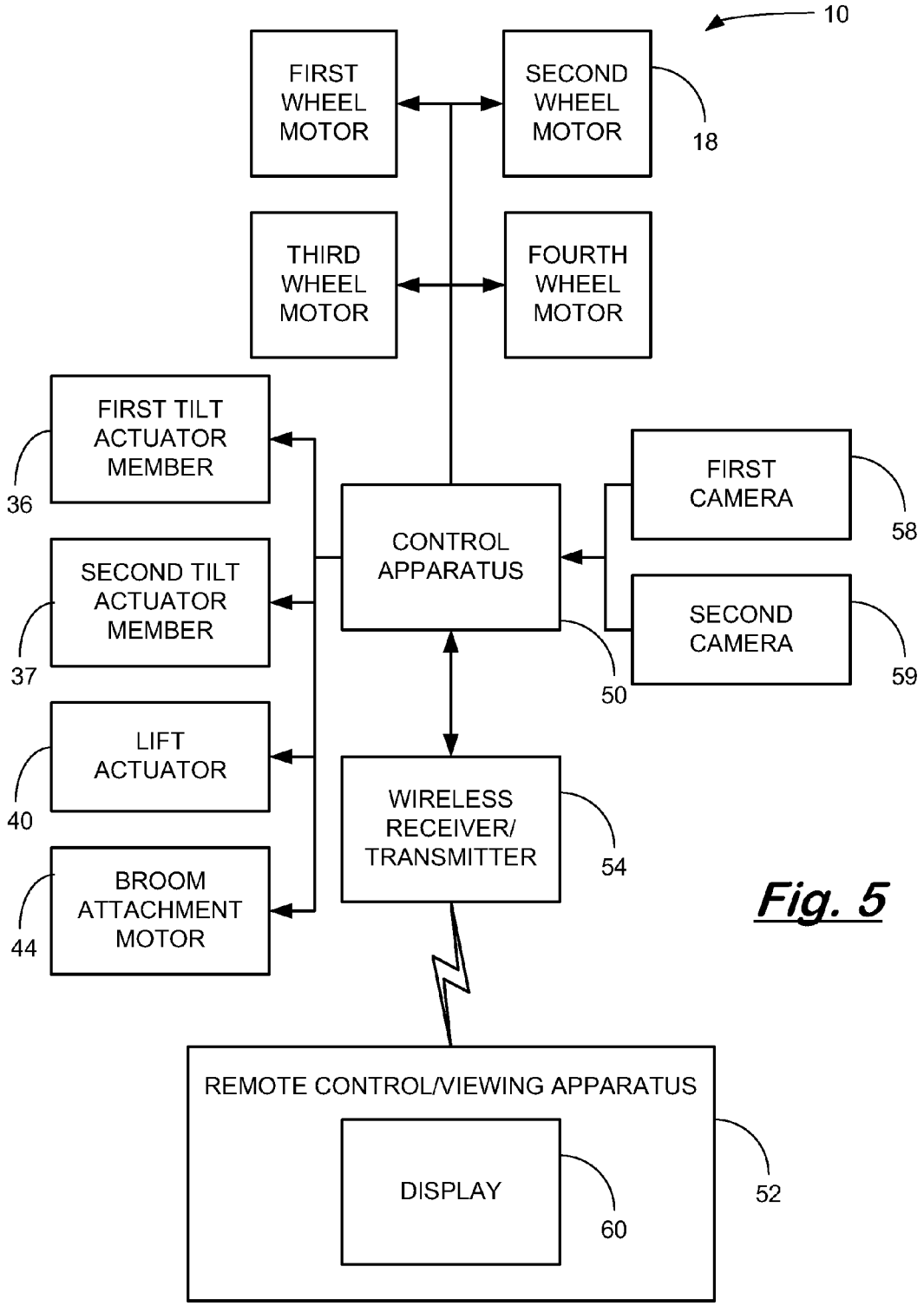
FIG. 5 is a schematic diagram of elements of the bin utility apparatus, according to an illustrative embodiment.
Figure 6:
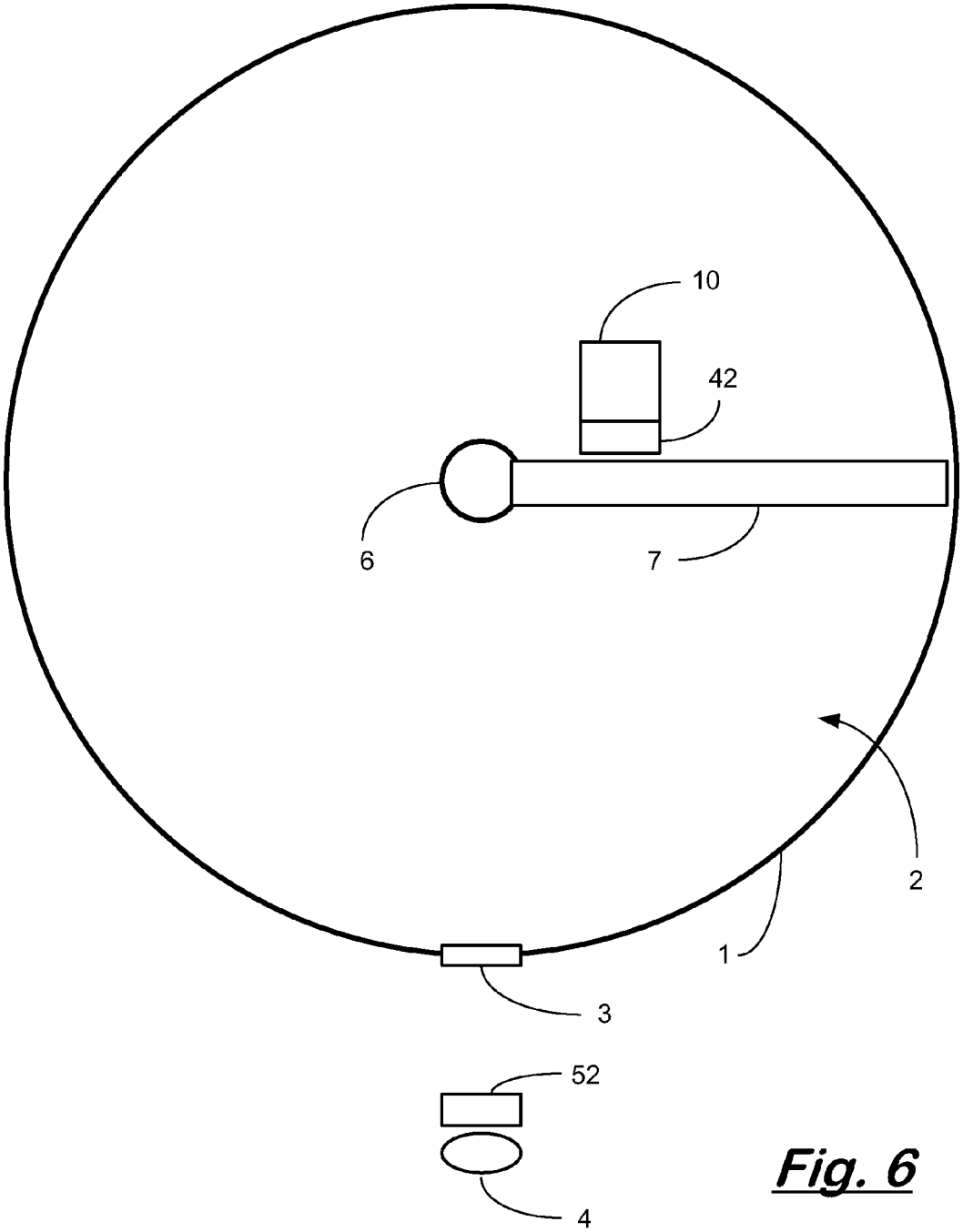
FIG. 6 is a schematic diagram of elements of a system in which the bin utility apparatus may be utilized.

With reference now to the drawings, and in particular to FIGS. 1 through 6 thereof, a new multifunction storage bin utility apparatus embodying the principles and concepts of the disclosed subject matter will be described.

Applicant has recognized that rules and practices that restrict the conditions under which a person may be present in the interior of a storage bin, such as minimum numbers of persons that must be present in the bin storage and the prohibition of any operation of equipment inside the storage bin while a person is located inside the bin interior, creates a problem for the convenient and efficient usage and maintenance of the storage bin and bin emptying equipment. For example, grain bin sweep augers, which are employed to move grain on the floor of the bin toward a well in the center of the bin floor, operate by axial rotation of the auger flighting as well as radial movement of the auger about the center of the bin floor. The rotation of the flighting and the radial movement of the auger may become blocked by accumulations or agglomerations of the grain inside the bin. This occurrence typically requires a person to enter the bin interior to clear the flighting and/or break up the grain agglomeration in order for the sweep auger to resume operation. However, this poses an extreme danger to the person or persons entering the bin interior, not only from the auger machinery but also from the grain within the interior of the bin, which may collapse, surround and suffocate the person. Due to the increasing frequency of deaths associated with maintaining and clearing the augers, rules and practices have been adopted that require more than one persons to be in the bin interior if anyone is working on the auger, and also require that the equipment be completely shut down while any person is inside the bin interior.

Applicant has further recognized that the provision of a remotely-controllable apparatus which includes various features and capabilities disclosed herein provides benefits for operating and maintaining a storage bin not otherwise available. The operator is able to avoid entering or working in the bin interior while the sin sweep auger may be operating, while still performing tasks to assist in the operation of the sweep auger. Further, additional clean up tasks may be performed without entering the bin interior.

In one aspect of the disclosure, a multifunction bin utility apparatus 10 may provide a means of performing actions and activities in the interior of a bin that would otherwise be performed by a person, but with the apparatus may be performed while the user or operator of the apparatus 10 remains at a relatively safer location than the interior of the bin, such as, for example, at or just outside a doorway in the perimeter wall of the bin. From such a vantage point, the operator may view the position and actions of the apparatus 10 without being inside the bin interior. Optionally, the apparatus may be equipped in a manner that permits the operator to view the position and actions of the apparatus 10 from the vantage point of the apparatus 10, and thus does not require that the operator have visual contact with the apparatus in order to know the position and actions of the apparatus, The bin utility apparatus 10 may include a mobile base 12 that generally has a front 14 and a rear 15, as well as a top and bottom. The mobile base may include a base frame 16 on which various other elements of the apparatus 10 are mounted. The apparatus 10 may also include means for moving the base frame across a surface such as a bin floor in a maneuverable manner. In the most preferred embodiments, the mobile base has a plurality of wheels 18 that are rotatably mounted on the base frame, and each of the wheels may be rotatable independently of each other, and driven independently of each other such as by each wheel being driven by an individual and separate motor. Each of the motors may be independently operable to make the mobile base moveable in a linear direction as well as being steerable through the differential rotation of the various wheels. In other less preferred embodiments, one or more of the wheels may be swivelable about a vertical axis to provide steering. Optionally, other less preferable embodiments may utilize other means of moving the mobile base, including a track system, articulating legs, and the like. The most preferred embodiments of the apparatus, and more specifically the mobile base, are sized and shaped to be able to move through an access opening of a storage bin, such as a doorway or manway. Illustratively, the mobile base may have a width of between approximately 20 inches and approximately 24 inches, and may have a length of approximately 36 inches to approximately 48 inches.

The apparatus 10 may also include a tool mount 20 that is movable with respect to the mobile base 12 to permit selective positioning of a tool attachment 22 with respect to the mobile base, and with respect to a surface (such as a bin floor) on which the mobile base is positioned. The attachment structures on the tool attachments may be standardized such that these structures cooperate with and complement the structures on the tool mount. In some embodiments, the tool mount 20 may be pivotable with respect to the mobile base, and may cause a corresponding pivot movement of a connected tool attachment. In some of the more preferred embodiments of the apparatus, the tool mount 20 may be configured to interchangeably mount different tool attachments 22 thereon.

The tool mount 20 may include an arm assembly 24 that may be configured to support the tool mount 20 and move the tool mount with respect to the mobile base 12. The arm assembly 24 may be pivotally mounted on the mobile base, and an inboard end portion 26 of the arm assembly may be mounted on the mobile base in a pivoting arrangement. The arm assembly 24 may also have an outboard end portion 28, and the tool mount 20 may be mounted on the outboard end portion. The outboard end portion 28 may be swung by pivot movement of the inboard end portion 26 with respect to the mobile base 12. The outboard end portion 28 may be movable from a position close to or adjacent to the front 14 of the mobile base toward the rear 15 of the mobile base.

In greater detail, the arm assembly 24 may include a swing arm 30 that may be pivotally mounted on the mobile base to permit pivot or swing movement of the swing arm with respect to the mobile base. A first end 32 of the swing arm is mounted on the mobile base, and the tool mount 20 may be mounted on a second end 33, and the tool mount may be pivotally mounted on the second end 33. In many of the most preferred embodiments of the apparatus 10, a pair of swing arms 30, 31 are employed, with the swing arms being laterally spaced from each other and attached to opposite side locations of the mobile base. A mounting rod 34 may connect the swing arms 30, 31 together at the first end 32 of the arm assembly.

The arm assembly 24 may further include a tilt actuator member 36 that is pivotally mounted on the mobile base 12, and may be pivotally mounted to the tool mount 20. The length of the tilt actuator member 36 between the mobile base 12 and the tool mount 20 may be adjustable to change the orientation of the tool mount with respect to the mobile base. In some of the more preferred embodiments, a pair of tilt actuator members 36, 37 is employed, with each of the tilt actuator members being generally pair with one of the swing arms on a side of the mobile base. The tilt actuator members 36, 37 and the swing arms 30, 31 may form a linkage between the mobile base and the tool mount, and each of the tilt actuator members may extend generally parallel to the corresponding swing arm, although this is not critical. In some embodiments, an inner end 38 of each the tilt actuator members may be mounted on the swing arm toward the first end 32 of the swing arm, and an outer end 39 of the actuator member 36 may be mounted on the tool mount.

The arm assembly 24 may also include a lift actuator 40 that is connected to the mobile base 12 and the swing arm 30 to pivot the swing arm with respect to the mobile base. The lift actuator 40 may comprise a rotational actuator that is mounted on the mobile base 12 and acts on the mounting rod 34. Illustratively, the rotational actuator may include gears or gearing mounted on the mounting rod and acted upon by gears mounted on a motor (not shown).

The apparatus 10 may include at least one, and in some embodiments a plurality of, tool attachments 22 which may be interchangeably mounted on the tool mount 20. On tool attachment 22 may comprise a scoop bucket 42 that has an opening, a bottom wall with a forward edge defining a portion of the opening, and a back wall extending upwardly with respect to the bottom wall, as well as side walls extending between the bottom wall and back wall. In some embodiments, the scoop bucket is formed of a non-metallic material to minimize damage that may occur should the scoop bucket strike or be pushed against an object such as the grain auger. Optionally, the scoop bucket 42 may further include a grapple that is pivotally mounted on the bucket and moves with respect to the opening of the bucket. Other tool attachments may be employed on the tool mount, including, for example, a snowblower attachment.

The apparatus 10 may also include a rotary broom attachment 44 that may be mounted on the mobile base 12 to move debris located on the ground surface below the mobile base 12. The broom attachment 44 may be removably mounted on the mobile base, and may be mounted toward the rear of the mobile base. The rotary broom of the attachment may be rotatable about a substantially vertical axis, although other orientations may be employed, and the bristles of the rotary broom may extend substantially downwardly with respect to the mobile base. The broom may be rotatable by a motor, such as an electrically driven motor, although other types of motors may be utilized.

Another aspect of the bin utility apparatus 10 may be a control apparatus 50 that is configured to control operation of elements of the apparatus, such as, for example, the motors that move various elements such as the wheels. The control apparatus 50 may also receive input from various sensors and inputs on the mobile base which may be used in controlling operation of other elements of the apparatus 50, or the data from these sensors and inputs may be transmitted to other locations. The control apparatus 50 may be located on the mobile base 12, and may be integrated therein.

The control apparatus 50 may be remotely controllable, or controllable by a person located a distance from the mobile base that is not adjacent to the mobile base, and in some of the more preferred embodiments, the control apparatus 50 is wirelessly controllable and thus responds to signals sent through the air by various wireless transmission technologies (e.g., radio frequency signals, infrared signals, etc.) The control apparatus 50 may include a remote control device 52 communicatively connected to a receiver 54 on the mobile base 12, and may communicate in a wireless manner. The remote control device 52 may thus be detached from and freely movable with respect to the mobile base, so that the remote control device may be moved and operated at a distance from the mobile base and the receiver mounted thereon. The control device 52 may be provided with various controls for various functions of the apparatus 10, including movement direction and speed, and movement of the tool mount and attachment with respect to the mobile base.

The bin utility apparatus 10 may also include a remote viewing apparatus 56 that may include at least one camera 58 that is mounted on the mobile base 12. Optionally, the remote viewing apparatus may include a pair of cameras 58, 59, with a first camera 58 being directed in a substantially forward-looking direction with respect to the mobile base and a second camera 59 being directed in a substantially rearward-looking direction with respect to the mobile base so that vision in both directions is possible using the remote viewing apparatus. The remote viewing apparatus 56 may also include a video display 60 configured to display video from the camera(s) 56, 57 on the mobile base. The video display 60 may be locatable remote from the mobile base, and may be located on the remote control device. The video display 60 may receive video signals wirelessly from the camera(s) to convert the video signals into images displayed on the video display.

In use of the bin utility apparatus 10 in a storage bin 1, the apparatus may be moved into the interior 2 of the bin through an opening 3 in the perimeter wall of the bin, and may be driven through the opening by its own wheels without the operator 4 having to enter the bin interior. Once inside the bin interior, the operator 4 may utilize direct visual contact with the apparatus 10 or the remote viewing apparatus 56 to control the apparatus using the remote control to send commands to the apparatus regarding, for example, direction and speed of movement, and the movement of the tool attachment by the arm assembly. The scoop bucket may be used to reposition grain in the bin, such as by pushing grain across the floor of the bin toward the well 6, lifting grain from the floor of the bin and deliver it to another location from where it was picked, and other actions. The scoop bucket may also be used to contact the grain sweep auger 7 to push it, or move grain away from the auger, particularly if the auger is jammed or clogged or otherwise rendered inoperable because of grain conditions. Further, when the broom attachment 44 is mounted on the mobile base, it may be operated through the control apparatus by the remote control for clearing up residual grain on the floor that might not have been gathered by the bin sweep auger.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A multifunction bin utility apparatus comprising:

a mobile base;

a plurality of wheels rotatably mounted on the mobile base, each of the wheels being rotatable independently of each other to steer movement of the mobile base;

a tool mount movable with respect to the mobile base;

an arm assembly mounted on the mobile base and configured to move the tool mount with respect to the mobile base;

at least one tool attachment mounted on the tool mount; and control apparatus configured to control movement of the plurality of wheels and the arm assembly, the control apparatus being remotely controllable by a remote control device;

wherein the arm assembly is mounted on the mobile base in a manner that permits the arm assembly to pivot about a substantially horizontal axis to move the tool attachment from a forward position in which the tool attachment is located substantially forward of the mobile base to a rearward position in which the tool attachment is located substantially rearward of the mobile base through said pivot movement about the substantially horizontal axis; and wherein the forward position of the tool attachment is characterized by the tool attachment being located forward of all of the wheels.

2. The apparatus of claim 1 wherein the control apparatus is wirelessly controllable from the remote control device.

3. The apparatus of claim 2 wherein the control apparatus includes a receiver mounted on the mobile base for wirelessly receiving commands from the remote control device.

4. The apparatus of claim 1 wherein each of the wheels is independently driven by an individual motor mounted on the mobile base.

5. The apparatus of claim 1 wherein the tool mount is pivotable with respect to the mobile base for changing the orientation of a tool attachment mounted on the tool mount.

6. The apparatus of claim 1 additionally comprising a remote viewing apparatus including at least one camera mounted on the mobile base and a video display configured to display video from the at least one camera, the video display being remote from the mobile base.

7. The apparatus of claim 6 wherein the video display is associated with the remote control device.

8. The apparatus of claim 7 wherein the video display receives video signals wirelessly from the at least one camera to convert the video signals to images displayed on the video display.

9. The apparatus of claim 6 wherein the at least one camera includes a pair of cameras, a first camera being directed in a substantially forward-looking direction with respect to the mobile base and a second camera being directed in a substantially rearward-looking direction with respect to the mobile base.

10. The apparatus of claim 1 wherein the at least one tool attachment is interchangeably mounted on the tool mount.

11. The apparatus of claim 1 wherein the at least one tool attachment comprises a scoop bucket positionable on the ground forward of the mobile base to fill the scoop bucket with particulate material when the mobile base is moved in a forward direction.

12. The apparatus of claim 1 additionally comprising a rotary broom attachment mounted on the mobile base and being configured to move debris located on the ground surface below the mobile base.

13. The apparatus of claim 12 wherein the rotary broom is rotatable about a substantially vertical axis.

14. The apparatus of claim 1 wherein the arm assembly comprises a pair of laterally spaced swing arms pivotally mounted on the mobile base.

15. The apparatus of claim 1 wherein the arm assembly comprises a swing arm pivotally mounted on the mobile base, a tilt actuator member pivotally mounted to the tool mount to tilt the tool mount with respect to the swing arm, and a lift actuator connected to the mobile base and the swing arm to pivot the swing arm with respect to the mobile base.

16. The apparatus of claim 1 wherein the control apparatus is wirelessly controllable from the remote control device;

wherein the control apparatus includes a receiver mounted on the mobile base for wirelessly receiving commands from the remote control device;

wherein each of the wheels is independently driven by an individual motor mounted on the mobile base;

wherein the tool mount is pivotable with respect to the mobile base for changing the orientation of a tool attachment mounted on the tool mount;

a remote viewing apparatus including at least one camera mounted on the mobile base and a video display configured to display video from the at least one camera, the video display being remote from the mobile base;

wherein the video display is associated with the remote control device;

wherein the video display receives video signals wirelessly from the at least one camera to convert the video signals to images displayed on the video display;

wherein the at least one camera includes a pair of cameras, a first camera being directed in a substantially forward-looking direction with respect to the mobile base and a second camera being directed in a substantially rearward-looking direction with respect to the mobile base;

wherein the at least one tool attachment is interchangeably mounted on the tool mount;

wherein the at least one tool attachment comprises a scoop bucket positionable on the ground forward of the mobile base to fill the scoop bucket with particulate material when the mobile base is moved in a forward direction;

a rotary broom attachment mounted on the mobile base and being configured to move debris located on the ground surface below the mobile base;

wherein the rotary broom is rotatable about a substantially vertical axis;

wherein the arm assembly comprises a pair of laterally spaced swing arms pivotally mounted on the mobile base;

wherein the arm assembly comprises a swing arm pivotally mounted on the mobile base, a tilt actuator member pivotally mounted to the tool mount to tilt the tool mount with respect to the swing arm, and a lift actuator connected to the mobile base and the swing arm to pivot the swing arm with respect to the mobile base;

wherein the mobile base has a width of approximately 20 inches to approximately 24 inches; and wherein the arm assembly is pivotally mounted on the mobile base in a manner such that the arm assembly is able to move the scoop bucket from a substantially upright orientation forward of the mobile base to a substantially inverted orientation rearward of the mobile base;

wherein the rearward position of the tool attachment is characterized by the tool attachment being located rearward of all of the wheels; and wherein the rearward position of the tool attachment is characterized by the tool attachment being located entirely rearward of all of the wheels.

17. A multifunction bin utility apparatus comprising:

a mobile base having a width of approximately 20 inches to approximately 24;

a plurality of wheels rotatably mounted on the mobile base, each of the wheels being rotatable independently of each other to steer movement of the mobile base;

a tool mount movable with respect to the mobile base;

an arm assembly mounted on the mobile base and configured to move the tool mount with respect to the mobile base;

at least one tool attachment mounted on the tool mount, the tool attachment comprising a scoop bucket; and control apparatus on the mobile base configured to control movement of the plurality of wheels and the arm assembly, the control apparatus including a receiver configured to wirelessly receive commands;

a remote control device configured to wirelessly transmit commands to the receiver of the control;

wherein the arm assembly is mounted on the mobile base by a pivot mounting so that the tool mount and tool attachment is movable in a substantially vertical plane from a position substantially forward of the mobile base to a position substantially rearward of the mobile base; and wherein the forward position of the tool attachment is characterized by the tool attachment being located entirely forward of the mobile base.

18. A multifunction bin utility apparatus comprising:

a mobile base;

a plurality of wheels rotatably mounted on the mobile base, each of the wheels being rotatable independently of each other to steer movement of the mobile base;

a tool mount movable with respect to the mobile base;

an arm assembly pivotally mounted on the mobile base and configured to move the tool mount with respect to the mobile base;

a scoop tool attachment removably mounted on the tool mount, at least one tool attachment mounted on the tool mount; and control apparatus configured to control movement of the plurality of wheels and the arm assembly, the control apparatus being remotely controllable by a remote control device;

wherein the arm assembly is configured to move the scoop tool attachment from a substantially upright orientation forward of the mobile base over the mobile base to a substantially inverted orientation positioned to dump contents of the scoop tool attachment rearwardly of the mobile base;

wherein the forward position of the tool attachment is characterized by the tool attachment being located entirely forward of the mobile base; and wherein the rearward position of the tool attachment is characterized by the tool attachment being located entirely rearward of the mobile base.

19. The apparatus of claim 1 wherein the rearward position of the tool attachment is characterized by the tool attachment being located rearward of all of the wheels.

20. The apparatus of claim 1 wherein the rearward position of the tool attachment is characterized by the tool attachment being at a location that is not over any portion of the mobile base.

* * * * *